US008134346B1

(12) United States Patent
Huta et al.

(10) Patent No.: US 8,134,346 B1
(45) Date of Patent: Mar. 13, 2012

(54) SYSTEM AND METHOD FOR POWER FACTOR CORRECTION

(75) Inventors: Henry N. Huta, Lithia, FL (US); Stephen R. Phillips, Fairport, NY (US); Robert E. Morgan, Lithia, FL (US)

(73) Assignee: EcoEarthEnergy, Inc., Lithia, FL (US)

( * ) Notice: Subject to any disclaimer, the term of this patent is extended or adjusted under 35 U.S.C. 154(b) by 417 days.

(21) Appl. No.: 12/455,335

(22) Filed: Jun. 1, 2009

Related U.S. Application Data

(60) Provisional application No. 61/057,571, filed on May 30, 2008.

(51) Int. Cl.
*G05F 1/70* (2006.01)
*G05F 5/00* (2006.01)

(52) U.S. Cl. ..... 323/211; 323/299

(58) Field of Classification Search ..... 323/205, 323/207–211, 299, 300, 303
See application file for complete search history.

(56) References Cited

U.S. PATENT DOCUMENTS 5,367,246 A 11/1994 Kaiser
5,736,838 A * 4/1998 Dove et al. ..... 323/211
6,377,037 B1 * 4/2002 Burns et al. ..... 324/142

* cited by examiner

*Primary Examiner* — Matthew Nguyen
(74) *Attorney, Agent, or Firm* — Molly L. Sauter; Ronald E. Smith; Smith & Hopen, P.A.

(57) ABSTRACT

A system and method for dynamically adjusting capacitance added in parallel to an electrical line input for improving efficiency of an electrical system. A microprocessor monitors in real time the current and voltage wave forms of a system and selects the optimum amount of capacitance from a bank of capacitors of different values. The system is implemented at the watt-hour meter to encourage adoption of the device by utility companies and customers.

17 Claims, 2 Drawing Sheets

SYSTEM AND METHOD FOR POWER FACTOR CORRECTION

CROSS REFERENCE TO RELATED APPLICATIONS

This application claims priority to U.S. Provisional Patent Application No. 61/057,571, "Active PFC", filed on May 30, 2008.

BACKGROUND OF THE INVENTION

Electrical loads in residential and industrial establishments tend to be reactive and not passive. The power factor of an alternating current (AC) electric power system is defined as being equal to the ratio of the real power to the apparent power of the load. The power factor is a number between zero and one and represents the efficiency of the load. In an electrical power system, a load with a low power factor draws more current than a load with a high power factor for the same amount of useful power transferred. Thus, it is desirable to have a load with a power factor as close as possible to unity. Due to the inductive nature of the majority of household appliances and machinery used in industrial applications, the power factor for these inductive loads is low. It is known in the art to add capacitance in parallel with the line input to raise the power factor to unity. As a result, savings in power consumption can be realized.

Currently in the market, power factor controllers are available which monitor the lead and lag in the power and automatically adjust the power factor by applying more or less capacitance as needed. However, power factor correction devices currently known in the art are designed to be installed at the electrical panel or alternatively they may be installed directly to each of the individual loads that require power factor correction. For a residential application, the factor power correction controller is usually connected to the fuse panel where the electricity is distributed to different locations within the house. As such, in order for the electrician to install the power factor correction controller, the electrician must have access to the residence and approval from the homeowner.

Utility companies are motivated to increase the power factor at each residence that they service because a power factor below one requires the utility to generate more than the minimum volt-amperes necessary to supply the real power (watts). A low power factor therefore increases generation and transmission costs for the utility company. However, the utility companies are deterred from installing residential power factor controllers because they must schedule the installation with the customer and they are concerned with possibility liability issues. Additionally, customers are reluctant to have a power factor controller installed due to the inconvenience associated with the installation inside their home.

Therefore, there exists a need in the art for a power factor controller that can be installed at an individual residence which does not require that the installer have access to the fuse panel inside the residence.

SUMMARY OF THE INVENTION

In accordance with the present invention is provided a power factor correction system which includes a power factor correction controller electrically coupled to a watt-hour meter adapter.

In a particular embodiment, the power factor correction controller of the system includes a capacitor bank, comprising a plurality of capacitors and a power factor correction circuit coupled to the capacitor bank for determining an existing power factor of a load and for selectively coupling one or more of the plurality of capacitors in parallel with the load to adjust the power factor towards unity.

In a specific embodiment, the power factor correction circuit further comprises a signal conditioning circuit coupled across a first and second alternating current incoming power lines, the signal monitoring circuit to sense a voltage signal supplied to a load by the first and second alternating current power lines and to sense a load current signal drawn by the load. The signal conditioning circuit also includes circuitry for filtering a noise signal from the sensed load current signal. An analog to digital conversion circuit is coupled to the signal monitoring circuit, the analog to digital conversion circuit to receive the sensed voltage signal and the sensed current signal and to generate a digital pulse representative of the zero-crossing of the voltage signal and the current signal. A digital signal processing and communications circuit is coupled to the analog to digital conversion circuit, the digital signal processing and communications circuit to receive the digital pulse representative of the zero-crossing of the voltage signal and the current signal, to determine a phase angle representative of an existing power factor of the load and to compare the existing power factor of the load to a preset threshold phase angle to determine if the existing power factor is leading or lagging. A capacitor switching circuit is coupled to the digital signal processing and communications circuit and to the capacitor bank, the capacitor switching circuit to selectively couple one or more of the plurality of capacitors in the capacitor bank to be in parallel with the load to adjust the power factor of the load towards unity.

The power factor correction circuit determines a time delay from the digital pulses provided by the analog to digital conversion circuit and converts the time delay to the phase angle representative of the existing power factor of the load.

The system includes a direct current power supply coupled to the incoming electrical lines to provide an operating voltage to the signal conditional circuit, the analog to digital conversion circuit, the digital signal processing and communications circuit and the capacitor switching circuit.

In a specific embodiment, the capacitor bank includes a plurality of capacitors of varying sizes to allow for course and fine adjustment of the power factor of the load. Additionally, at least one capacitor from the bank is always coupled in parallel with the load to protect the load from voltage spikes on the incoming power lines.

The power factor correction circuit may also selectively decouple one or more of the plurality of capacitors in parallel with the load to adjust the power factor of the load towards unity as determined by the existing power factor of the load. The capacitors that are decoupled from the circuit are de-energized to prevent a current or voltage surge when the system reselects the capacitor.

To make an accurate determination of the existing power factor, the power factor correction circuit of the present invention further comprises circuitry to cause the power factor correction circuit to determine the existing power factor a plurality of times within a predetermined amount of time and to average the results of the plurality of determinations to determine the existing power factor.

Additionally, the power factor correction circuit further comprises circuitry to cause the power factor correction circuit to determine the existing power factor following each selective coupling of one or more of the plurality of capacitors. As such, the existing power factor is recalculated each time a capacitor from the capacitor bank is coupled or decoupled from the circuit.

In accordance with the present invention, a method for correcting a power factor of a load circuit is provided which includes positioning a watt-hour meter adapter between an existing watt-hour meter socket and a watt-hour meter, wherein the watt-hour meter adapter is electrically coupled to a power factor correction controller. After the power factor correction controller is positioned in parallel with the incoming electrical lines via the watt-hour meter adapter, the method of the present invention continues by sensing the power supply voltage signal at the watt-hour meter, sensing the load current signal, determining the existing power factor of the load from the sensed power supply voltage signal and the sensed load current signal and selectively coupling or decoupling capacitors in parallel with the load circuit to correct the power factor of the load circuit to approximately unity.

The existing power factor of the load is determined by identifying the zero-crossing of the sensed voltage signal to generate a digital pulse representative of the zero-crossing of the voltage signal, identifying the zero-crossing of the sensed load current signal to generate a digital pulse representative of the zero-crossing of the load current signal, determining a time delay between the voltage signal and the current signal by comparing the digital pulse representative of the zero-crossing of the voltage signal to the digital pulse representative of the zero-crossing of the load current signal, converting the time delay to a phase angle representative of the existing power factor of the load and comparing the phase angle to a preset threshold phase angle to determine if the existing power factor is leading or lagging.

To make an accurate determination of the existing power factor, the power factor of the load is determined a plurality of times, using the previously described method, within a predetermined amount of time and the results are averaged to determine the existing power factor of the load. Additionally, the existing power factor of the load is determined each time a capacitor is selectively coupled or decoupled from the load.

DETAILED DESCRIPTION OF THE PREFERRED EMBODIMENT

In accordance with the present invention, a system and method are provided for correcting a power factor by measuring the power factor of the load and then electronically adding capacitance in parallel to the load to optimize the power factor toward a value of unity. The invention has the advantage that as appliances and loads are added and or subtracted from the system the value of the capacitance added to correct for the inductive component is adjusted in real time. The invention maximizes efficiency of the overall system and so minimizes the energy cost to the consumer. Additionally, with the present invention, the power factor correction system is electrically connected to the load at the watt-hour meter. As such, with the present invention, it is not necessary for the installer of the system to have access to the interior of the building.

In the electric utility industry, watt-hour meters are commonly employed to measure electric power consumption at a residential or commercial building. These watt-hour meters are mounted on a wall via a socket. The socket contains terminals which are connected to the incoming electric lines. The socket terminals are also connected to conductors residing within the socket which extend to jaw contacts which are designed to receive the blade terminals of a plug-in watt-hour meter.

Figure 1:
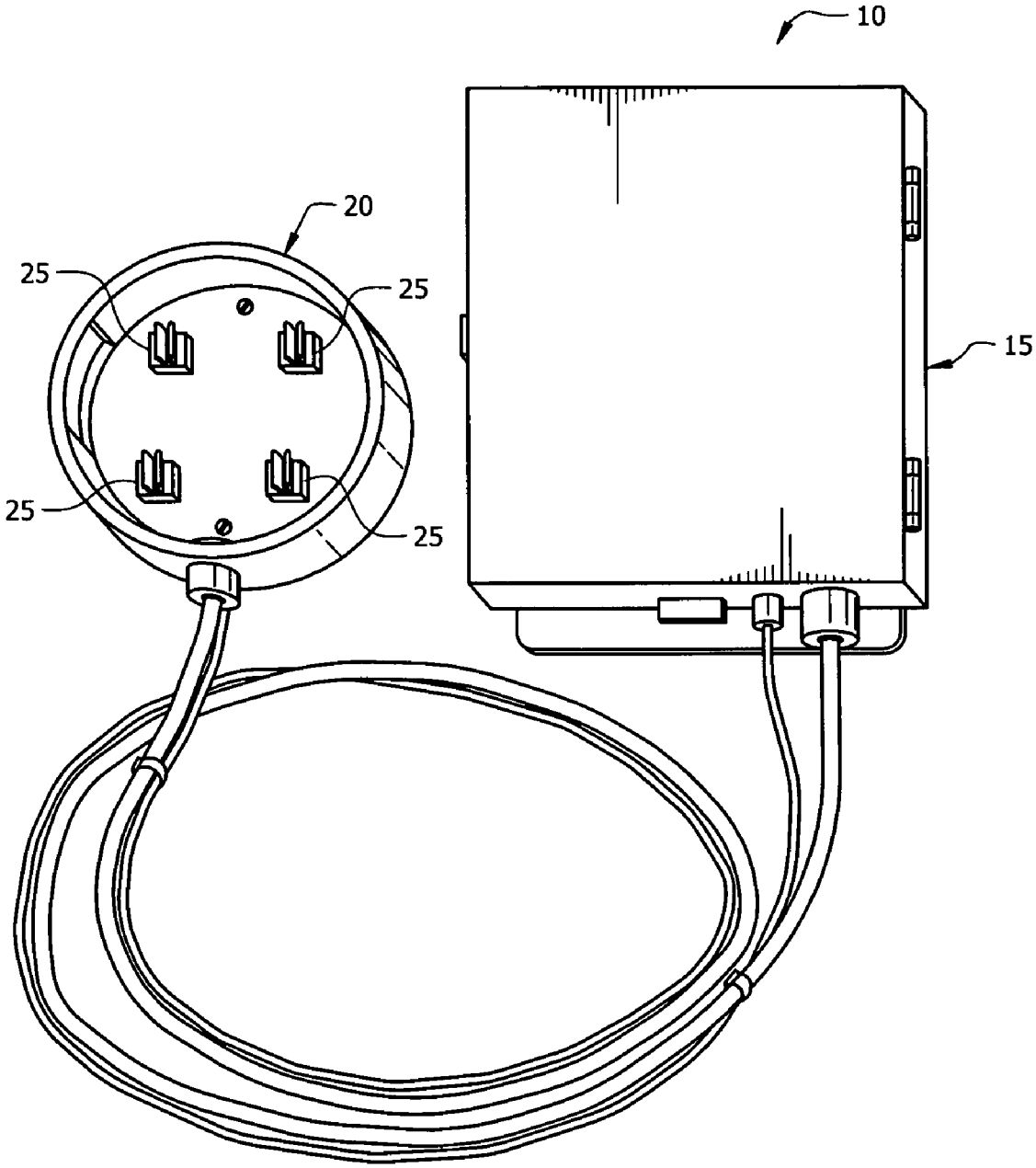
FIG. 1 is a diagrammatic view of the power factor correction system in accordance with the present invention.

With reference to FIG. 1, in accordance with the present invention the power factor correction system 10 includes a power factor correction controller 15 and a watt-hour meter adapter 20 electrically coupled to the power factor correction controller 15.

The watt-hour meter adapter 20 of the present invention provides for the installation of the power factor correction controller 15 at the existing watt-hour meter of the residence or business. An existing watt-hour meter is coupled to a building through a watt-hour meter socket. In accordance with the present invention, the watt-hour meter is removed from the socket and the watt-hour meter adapter 20 is then inserted into the socket. The watt-hour meter is then inserted into the watt-hour meter adapter 20. The power factor correction controller 15 is electrically coupled to the watt-hour meter adapter 20. Accordingly, the power factor correction controller 15 is then coupled in parallel with the load of the residence through the watt-hour meter adapter 20.

In a particular embodiment, the watt-hour meter adapter 20 comprises jaw blades 25 for receiving the blade terminals of the watt-hour meter. The ends of the jaw blades 25 of the watt-hour meter adapter 20 extend through the adapter for plug-in connection to the watt-hour meter socket.

Once the power factor correction controller 15 is connected to the incoming electrical lines through the watt-hour meter adapter 20, the power factor correction controller 20 serves to correct the power factor for varying reactive loads.

Figure 2:
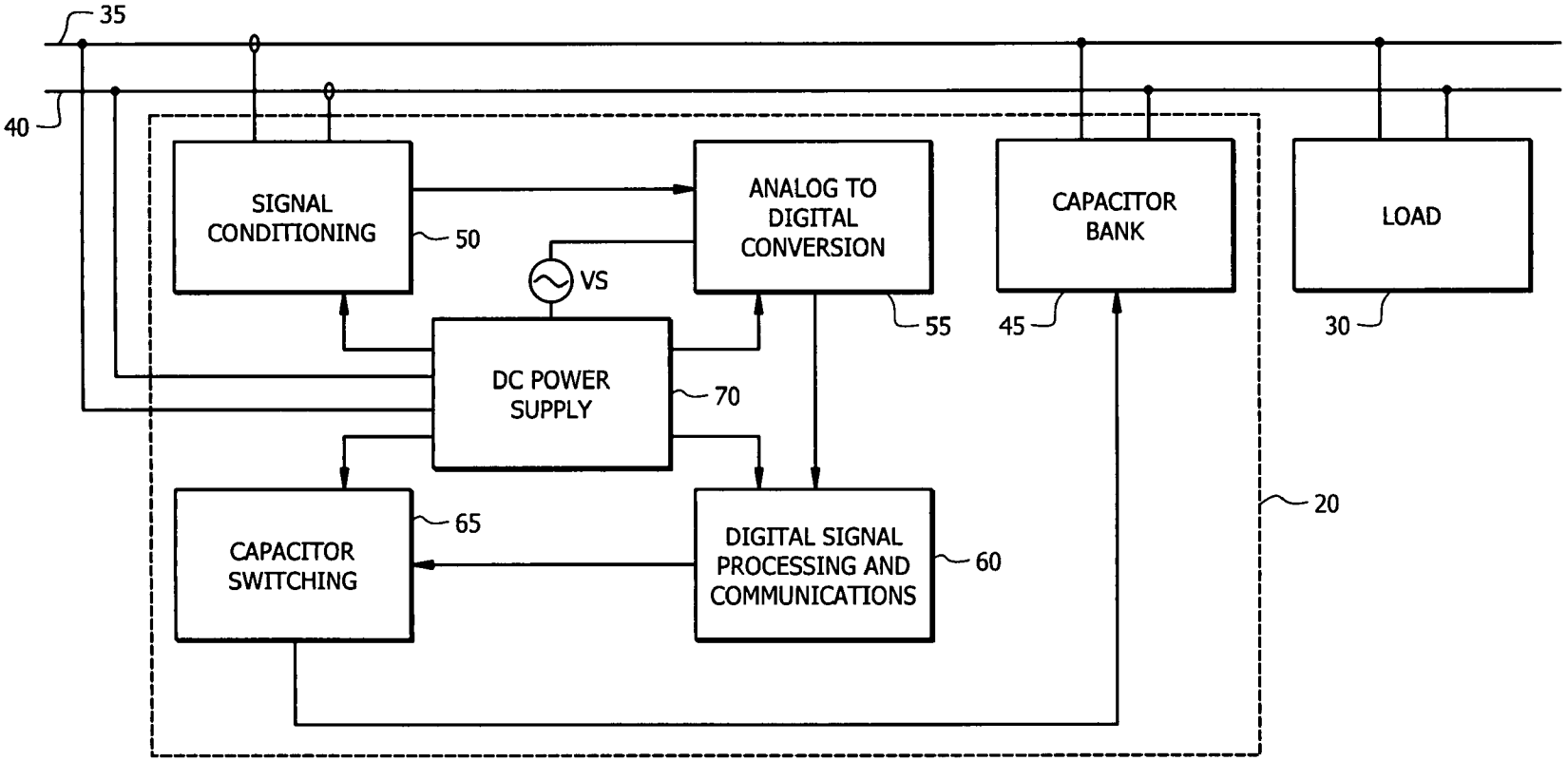
FIG. 2 is a block diagram of an embodiment of the power factor correction controller in accordance with the present invention.

With reference to FIG. 2, a block diagram of the power factor correction controller 15 is provided to illustrate the main components of the power factor correction controller 20 and their association with the incoming electrical lines and the load. As previously mentioned, the power factor of the load varies as the reactive elements present in the load vary.

As shown with reference to FIG. 2, the varying reactive load 30 is coupled across a first and second incoming alternating electrical current power lines 35, 40. The power factor correction controller 20 is coupled across the incoming electrical lines 35, 40 and is positioned between the incoming lines and the load 30, such that the power factor correction controller 20 is in parallel with the load 30. The power factor correction controller 20 includes a capacitor bank 45 coupled across the incoming electrical lines 35, 40. The capacitor bank 45 is comprised of an array of capacitors of varying sizes to allow for course and fine adjustment of the power factor of the load 30. Power factor correction is accomplished by automatically switching capacitors from the capacitor bank 45 in and out of the load circuit to achieve a power factor approximating unity.

Prior to correcting the power factor, it is necessary to first determine the existing power factor of the load. The existing power factor is determined by measuring the phase relationship between the incoming voltage and the load current. It is known that the power factor is the cosine of the phase angle between the load current and the incoming voltage sinusoidal waveforms. The power factor is equal to unity when the voltage and the current are in phase, and is equal to zero when the current leads or lags the voltage by 90°.

In a particular embodiment of the present invention, to determine the existing power factor of the load, the system senses the incoming voltage signal and the load current signal and a signal conditioning circuit 50 filters the load current signal to remove any noise in the signal. These signals are then fed to an analog to digital conversion circuit 55 which comprises a zero-crossing circuit for the sensed voltage signal and a zero-crossing circuit for the sensed current signal. The analog to digital conversion circuit 55 generates digital pulses representative of the zero-crossing of the voltage signal and the current signal which are then fed to the digital signal processing and communications circuit 60. The digital signal processing and communications circuit 60 then determines a time delay from the digital pulses and converts the time delay to a phase angle representative of the existing power factor of the load. The voltage and current signals are measured and the phase angle is determined at several hundred cycles a second and the results are averaged to determine the existing power factor. The digital signal processing and communications circuit 60 is then used to compare the phase angle representative of the existing power factor against a preset threshold phase angle to determine if the existing power factor is leading or lagging. When the load is inductive, the load current lags the incoming voltage, and the power factor is said to be a lagging power factor. When the load is capacitive, the load current leads the incoming voltage and the power factor is said to be a leading power factor. The results of this comparison are communicated to the capacitor switching circuit 65 which then increments or decrements the capacitor bank 45. The capacitor bank 45 is positioned in parallel with the load such that the incrementing and/or decrementing of the capacitors in the capacitor bank 45 results in the adjustment of the power factor to approximately unity. In this embodiment, capacitance is added in equal increments and the process of determining the existing power factor is repeated after each increment. The circuit elements of the power factor correction controller 20 are powered through a direct current power supply 70 coupled to the incoming power lines 35, 40.

The load on the circuit varies as different appliances and machinery are switched on and off. In accordance with the present invention, the power factor is measured and capacitance is electronically added to the system to optimize the power factor towards a value of one. This has the advantage that as appliances and loads are added and/or subtracted from the system, the value of the capacitance added to correct for the inductive component is adjusted in real time, therefore maximizing the efficiency of the overall system and so minimizing the energy cost to the consumer.

In the present invention, the measurement of the current waveform monitors the zero crossing point and therefore allows for the switching of capacitors in a momentarily cold state. This ensures that no large transients are added to the electrical network inside the establishment.

Additionally, once a capacitor has been switched out of the system it is de-energized to prevent a current or voltage surge from occurring when the system reselects it.

In a particular embodiment, the power factor correction system is implemented in a single-phase system, however this is not meant to be limiting and the power factor correction system could also be implemented in a three-phase system.

The system in accordance with the present invention, installed in a household or industrial environment, will maximize efficiency and hence maximize the reduction of energy costs. Additionally, the present invention can be sized to applications of varying load and varying power factor, by adjusting the value and number of capacitors incorporated into the device.

As most establishments are inductive in nature, in accordance with the present invention one capacitor is constantly selected. This provides for immunity to appliances in the establishment from external voltage spikes form naturally occurring phenomenon. (e.g. lightening and electrical storms). Incorporating this with an array of electronically switchable capacitors allows the system to optimize the power factor and provide voltage spike protection concurrently.

What is claimed is:

1. A power factor correction system, comprising:

a power factor correction controller, the power factor correction controller comprising:

a capacitor bank, comprising a plurality of capacitors; and a power factor correction circuit coupled to the capacitor bank for determining an existing power factor of a load and for selectively coupling one or more of the plurality of capacitors in parallel with the load to adjust the power factor towards unity, the power factor correction circuit comprising:

a signal conditioning circuit coupled across a first and second alternating current incoming power lines, the signal monitoring circuit to sense a voltage signal supplied to a load by the first and second alternating current power lines and to sense a load current signal drawn by the load;

an analog to digital conversion circuit coupled to the signal monitoring circuit, the analog to digital conversion circuit to receive the sensed voltage signal and the sensed current signal and to generate a digital pulse representative of the zero-crossing of the voltage signal and the current signal;

a digital signal processing and communications circuit coupled to the analog to digital conversion circuit, the digital signal processing and communications circuit to receive the digital pulse representative of the zero-crossing of the voltage signal and the current signal, to determine a phase angle representative of an existing power factor of the load and to compare the existing power factor of the load to a preset threshold phase angle to determine if the existing power factor is leading or lagging; and a capacitor switching circuit coupled to the digital signal processing and communications circuit and to the capacitor bank, the capacitor switching circuit to selectively couple one or more of the plurality of capacitors in the capacitor bank to be in parallel with the load to adjust the power factor of the load towards unity; and a watt-hour meter adapter electrically coupled to the power factor correction controller.

2. The power factor correction circuit of claim 1, wherein the digital signal processing and communications circuit further comprises circuitry to determine a time delay from the digital pulses and to convert the time delay to the phase angle representative of the existing power factor of the load.

3. The power factor correction circuit of claim 1, wherein the signal conditioning circuit further comprises circuitry for filtering a noise signal from the sensed load current signal.

4. The power factor correction circuit of claim 1, further comprising a direct current power supply coupled to the incoming electrical lines, the direct current power supply to supply an operating voltage to the signal conditional circuit, the analog to digital conversion circuit, the digital signal processing and communications circuit and the capacitor switching circuit.

5. The system of claim 1, wherein the plurality of capacitors of the capacitor bank are varying sizes to allow for course and fine adjustment of the power factor of the load.

6. The system of claim 1, wherein at least one capacitor is always coupled in parallel with the load to protect the load from voltage spikes on the incoming power lines.

7. The system of claim 1, wherein the power factor correction circuit selectively decouples one or more of the plurality of capacitors in parallel with the load to adjust the power factor of the load towards unity.

8. The system of claim 7, wherein the power factor correction circuit further comprises circuitry to de-energize a decoupled capacitor.

9. The system of claim 1, wherein the power factor correction circuit further comprises circuitry to cause the power factor correction circuit to determine the existing power factor a plurality of times within a predetermined amount of time and to average the results of the plurality of determinations to determine the existing power factor.

10. The system of claim 1, wherein the power factor correction circuit further comprises circuitry to cause the power factor correction circuit to determine the existing power factor following each selective coupling of one or more of the plurality of capacitors.

11. A method for correcting a power factor of a load circuit, the method comprising:

positioning a watt-hour meter adapter between an existing watt-hour meter socket and a watt-hour meter, the watt-hour meter adapter electrically coupled to a power factor correction controller;

sensing the power supply voltage signal at the watt-hour meter;

sensing the load current signal;

determining the existing power factor of the load from the sensed power supply voltage signal and the sensed load current signal, wherein determining the existing power factor of the load comprises:

identifying the zero-crossing of the sensed voltage signal to generate a digital pulse representative of the zero-crossing of the voltage signal;

identifying the zero-crossing of the sensed load current signal to generate a digital pulse representative of the zero-crossing of the load current signal;

determining a time delay between the voltage signal and the current signal by comparing the digital pulse representative of the zero-crossing of the voltage signal to the digital pulse representative of the zero-crossing of the load current signal;

converting the time delay to a phase angle representative of the existing power factor of the load; and comparing the phase angle to a preset threshold phase angle to determine if the existing power factor is leading or lagging; and selectively coupling or decoupling capacitors in parallel with the load circuit to correct the power factor of the load circuit to approximately unity.

12. The method of claim 11, further comprising filtering the sensed load current to remove noise from the signal.

13. The method of claim 11, further comprising de-energizing capacitors that have been decoupled from the load.

14. The method of claim 11, further comprising positioning at least one capacitor in parallel with the load to protect the load from voltage spikes.

15. The method of claim 11, wherein determining the existing power factor of the load further comprises, determining the power factor of the load a plurality of times within a predetermined amount of time and averaging the results of the plurality of determinations to determine the existing power factor of the load.

16. The method of claim 11, wherein determining the existing power factor of the load further comprises, determining the existing power factor of the load each time a capacitor is selectively coupled or decoupled.

17. The method of claim 11, further comprising monitoring the zero-crossing point of the load current signal to insure that the capacitors that are selectively coupled to the load circuit are in a momentarily cold state.

* * * * *